US006257188B1

(12) United States Patent
Fujii et al.

(10) Patent No.: US 6,257,188 B1
(45) Date of Patent: Jul. 10, 2001

(54) STRUCTURE FOR MOUNTING CYLINDER HEAD COVER OF INTERNAL COMBUSTION ENGINE

(75) Inventors: Noriaki Fujii; Kouta Yoshiura, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/386,143

(22) Filed: Aug. 31, 1999

(30) Foreign Application Priority Data

Sep. 2, 1998 (JP) ..... 10-248838

(51) Int. Cl.[7] ..... F01M 9/10

(52) U.S. Cl. ..... 123/90.38; 123/195 C; 123/198 E

(58) Field of Search ..... 123/90.27, 90.38, 123/193.3, 193.5, 195 C, 198 E, 90.1

(56) References Cited

U.S. PATENT DOCUMENTS

| | | | | |
|---|---|---|---|---|
| 4,027,644 | * | 6/1977 | Timour | 123/198 E |
| 4,495,903 | * | 1/1985 | Asano | 123/90.38 |
| 4,715,335 | * | 12/1987 | Elsbett et al. | 123/198 E |
| 4,727,833 | * | 3/1988 | Nakashima | 123/195 C |
| 5,161,499 | * | 11/1992 | Bachschmid et al. | 123/195 C |
| 5,279,265 | * | 1/1994 | Matsuo et al. | 123/195 C |
| 5,365,901 | * | 11/1994 | Kiczek | 123/195 C |
| 5,370,090 | * | 12/1994 | Murata et al. | 123/90.38 |
| 5,645,025 | * | 7/1997 | Caya et al. | 123/90.38 |
| 5,655,489 | * | 8/1997 | Kammerer et al | 123/90.38 |
| 5,803,034 | * | 9/1998 | Gruber et al. | 123/90.38 |
| 5,845,616 | * | 12/1998 | Schwarzenthal et al. | 123/90.38 |
| 5,896,837 | * | 4/1999 | Nysten et al. | 123/90.38 |
| 5,957,100 | * | 9/1999 | Frohwerk et al. | 123/90.38 |
| 6,085,709 | * | 7/2000 | Freese | 123/90.38 |

FOREIGN PATENT DOCUMENTS

| | | |
|---|---|---|
| 56-101449 | 12/1981 | (JP) . |
| 58-162395 | 10/1993 | (JP) . |

* cited by examiner

*Primary Examiner*—Philip H. Leung
*Assistant Examiner*—Fadi H. Dahbour
(74) *Attorney, Agent, or Firm*—Armstrong, Westerman, Hattori, McLeland & Naughton, LLP

(57) ABSTRACT

An internal combustion engine 1 in which an outer peripheral edge of a cylinder head cover 25 abuts against a cylinder head 2, and the cylinder head cover 25 is mounted on the cylinder head 2, a recessed portion 26 is formed in a central portion of the cylinder head cover as viewed in a widthwise direction perpendicular to a crankshaft, a coil spring 32 is loosely fitted over a connecting member 28 which is passed through the recessed portion 26 and has one end fixed to the cylinder head. The coil spring 32 in a compressed state is clamped by a bottom surface of the recessed portion 26 of the cylinder head cover 25 and a spring receiving portion 33 at another end of the connecting member 28. The coil spring 32, the connecting member 28, and the spring receiving portion 33 are accommodated within the recessed portion 26 of the cylinder head cover 25.

22 Claims, 6 Drawing Sheets

STRUCTURE FOR MOUNTING CYLINDER HEAD COVER OF INTERNAL COMBUSTION ENGINE

BACKGROUND OF THE INVENTION

1. Field of the Invention

The present invention relates to a structure for mounting a cylinder head cover of an overhead valve-type internal combustion engine having a valve mechanism in a cylinder head.

2. Description of the Related Art

As internal combustion engines in which a cylinder head cover is mounted on a cylinder head by using bolts and coil springs, those which are disclosed in Japanese Utility Model Unexamined Publication Nos. 101449/1981 and 162395/1983 are known.

In the internal combustion engine disclosed in Japanese Utility Model Unexamined Publication No. 101449/1981, each bolt is split into a bolt head and an externally threaded portion, upper and lower end portions of the coil spring are integrally coupled to a lower end of the bolt head and an upper end of the externally threaded portion, a collar portion is formed on an upper end of a rubber boot capable of fitting over an outer periphery of the coil spring, and the rubber boot is fitted and inserted in a through hole formed in a flange portion of the cylinder head cover. The externally threaded portion, the coil spring, and the bolt head are consecutively fitted and inserted in the rubber boot, and after a tip of the externally threaded portion is made to abut against an internally threaded portion in the cylinder head, the bolt head is rotated so as to screw the externally threaded portion into the internally threaded portion, thereby mounting the cylinder head cover onto the cylinder head.

In this device, since the torque applied to the bolt head is transmitted to the externally threaded portion by means of the coil spring, unless the torsional rigidity of the coil spring is very high, the externally threaded portion cannot be securely threadedly engaged in the internally threaded portion and is liable to come off. If the torsional rigidity of the coil spring is increased to overcome this problem, the compressive rigidity of the coil spring also becomes high correspondingly, so that there is a drawback in that the effect of resiliently mounting the head cover declines appreciably.

Meanwhile, with the internal combustion engine disclosed in Japanese Utility Model Unexamined Publication No. 162395/1983, internally threaded portions are formed in a rocker shaft holder for pivotally supporting a rocker arm, coil springs are loosely fitted over external threads which penetrate the cylinder head cover from above to below, and the external threads are threadedly secured in the internally threaded portions, wherein the peripheral edge portion of the cylinder head cover is pressed against the cylinder head through packing by means of the spring forces of the coil springs.

With the with the internal combustion engine disclosed in Japanese Utility Model Unexamined Publication No. 162395/1983, top portions of the external threads substantially project upward from the top surface of cylinder head cover, and the overall height of the internal combustion engine becomes high, so that it is difficult to make the internal combustion engine compact.

In addition, if the amount of projection of the external threads from the cylinder head cover is made small, the rigidity of the coil springs becomes high, and the force with which the cylinder head cover is pressed changes substantially with respect to the change in the amount of screwing in of the external threads, making it difficult to obtain an appropriate pressing force.

SUMMARY OF THE INVENTION

The invention of this application relates to an improvement of the structure for mounting a cylinder head cover of an internal combustion engine which overcomes the above-described drawbacks. According to a first aspect of the invention, there is provided a structure for mounting a cylinder head cover of an internal combustion engine in which an outer peripheral edge of a cylinder head cover abuts against a cylinder head, and the cylinder head cover is mounted on the cylinder head, including: a connecting member passed through a recessed portion which is formed in a central portion of the cylinder head cover as viewed in a widthwise direction perpendicular to a crankshaft, the connecting member having one end fixed to the cylinder head and the other end provided with a spring receiving portion, and a coil spring arranged around the connecting member, the coil spring being clamped in a compressed state between a bottom surface of the recessed portion of the cylinder head cover and the spring receiving portion. The coil spring, the connecting member, and the spring receiving portion are accommodated within the recessed portion of the cylinder head cover.

Since the present invention is arranged as described above, the connecting member does not project upward from the recessed portion of the cylinder head cover, and the coil spring and the spring receiving portion are accommodated within the recessed portion of the cylinder head cover, thereby making it possible to attain a compact internal combustion engine.

In addition, since the length and the winding diameter of the coil spring can be made large in correspondence with the depth and area of the recessed portion of the cylinder head cover, it is possible to use a coil spring having a large amount of deformation and a small spring constant. Hence, the cylinder head cover can be mounted on the cylinder head with a pressing force of a such a magnitude that allows the cylinder head cover to be pressed against the cylinder head appropriately. In addition, its pressing force can be finely adjusted.

Further, according to a second aspect of the invention, there is provided a structure for mounting a cylinder head cover of an internal combustion engine in which an outer peripheral edge of a cylinder head cover abuts against a cylinder head, and the cylinder head cover is mounted on the cylinder head, including: a connecting member passed through a recessed portion which is formed in an upper portion of the cylinder head cover, the connecting member having one end fixed to the cylinder head and the other end provided with an upper spring receiving portion; and a coil spring arranged around the connecting member, the coil spring being clamped in a compressed state between the upper spring receiving portion and a lower spring receiving portion provided in a bottom surface-side of the recessed portion of the cylinder head cover and by means of an annular elastic member. The lower spring receiving portion is accommodated within the recessed portion of the cylinder head cover.

With the above structure, the projecting length of the connecting member projecting from the upward portion of the cylinder head cover can be formed as short as possible, thereby making it possible to attain a compact internal combustion engine.

Further, according to a third aspect of the invention, there is provided a structure for mounting a cylinder head cover of an internal combustion engine in which an outer peripheral edge of a cylinder head cover abuts against a cylinder head, and the cylinder head cover is mounted on the cylinder head, including: a connecting member passed through a recessed portion which is formed in an upper portion of the cylinder head cover, the connecting member having one end fixed to the cylinder head and the other end provided with a spring receiving portion; and a coil spring arranged around said connecting member, the coil spring being clamped in a compressed state between a bottom surface of said recessed portion of the cylinder head cover and the spring receiving portion. The connecting member is secured to the cylinder head between an intake camshaft and an exhaust camshaft, which are provided within the cylinder head cover.

In a conventional case that the connecting member such as a bolt is mounted on a camshaft holder or the like, located above the cam shaft, it is difficult to secure the length of a fastening portion of the bolt, whereby there is a fear that the retaining force of the coil spring is decreased. In addition, when the length of the fastening portion is increased, the size of the internal combustion engine is enlarged. Further, even when the connecting member is provided outside the camshaft, the connecting member, the coil spring loosely fitted around the connecting member, and the coil spring receiving portion are pushed out outside, whereby the size of the internal combustion engine is also enlarged. However, with the structure of the third aspect, since the connecting member is secured to the cylinder head side between the intake and exhaust camshafts, the connecting member is secured to the cylinder head side while utilizing space between the intake and exhaust camshafts effectively, whereby the spring is stably retained, and it is possible to attain a compact internal combustion engine.

Moreover, the connecting member may secured to a connecting portion which integrally connects a camshaft holder for respectively supporting an intake camshaft and an exhaust camshaft which are respectively located on both sides of said recessed portion of the cylinder head cover.

With the above structure, the coil spring connecting member and the spring receiving portion can be provided by making effective use of the recessed portion of the cylinder head cover which is formed between the intake camshaft and the exhaust camshaft. Moreover, the rigidity in mounting the cylinder head cover can be increased by shortening the length of the connecting member.

In addition, one end of said coil spring may abut against said cylinder head cover by means of an annular elastic member, a head cover-side end portion of the annular elastic member may be fitted between the cylinder head cover and the connecting member, and a radially positioning stepped portion interposed in an inner surface of the coil spring is formed at the other end portion of the annular elastic member.

Furthermore, since the recessed portion of the head cover is positioned and fitted to a proximal portion of the connecting member through the head cover-side end portion of the aforementioned annular elastic member, the head cover can be supported stably. At the same time, the vibrations transmitted to the connecting member from the internal combustion engine can be dampened by the annular elastic member and can be prevented from being transmitted to the head cover, thereby making it possible to reduce the noise level as practically as possible.

Moreover, the positioning of the coil spring can be performed reliably without making the elastic member large in size.

DETAILED DESCRIPTION OF THE PREFERRED EMBODIMENTS

Figure 1:
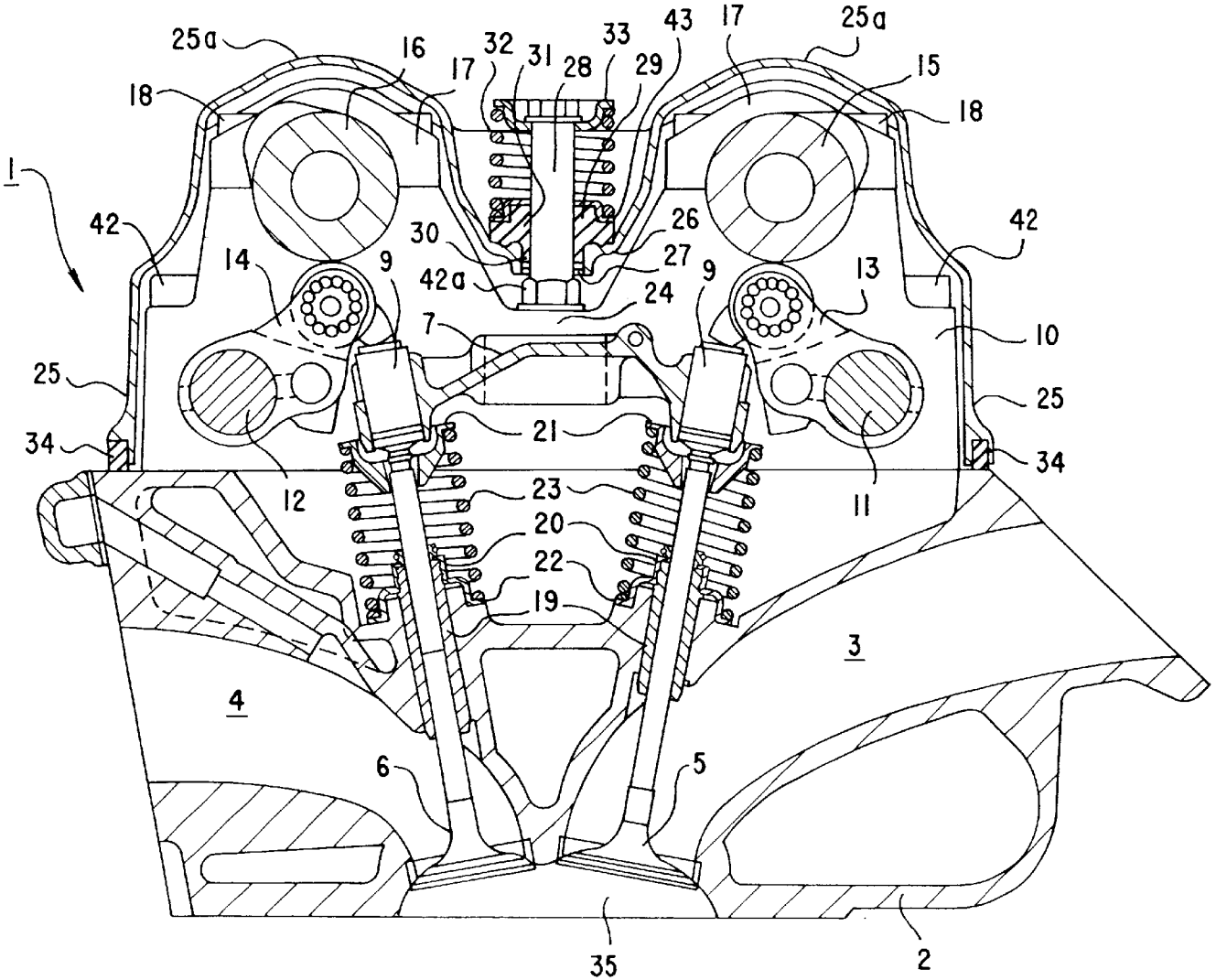
FIG. 1 is a transverse cross-sectional view illustrating a structure for mounting a cylinder head cover of an internal combustion engine according to the present invention.

Hereafter, a description will be given of an embodiment of the present invention illustrated in FIGS. 1 to 3.

An internal combustion engine 1 is a four-stroke cycle V-type eight-cylinder (four-cylinder on one side) overhead valve internal combustion engine. As shown in FIG. 1, an intake passage 3 is formed on the inner side (right-hand side in FIG. 1) of a V-bank of a cylinder head 2, while an exhaust passage 4 is formed on the outer side of the V-bank. An intake valve 5 and an exhaust valve 6 are openably provided in combustion chamber end portions of the intake passage 3 and the exhaust passage 4, respectively.

In addition, a hydraulic tappet holder 7 is integrally attached to the cylinder head 2 for each cylinder by means of bolts 8. Hydraulic tappets 9 are slidably fitted in the hydraulic tappet holder 7 so that lower ends of the hydraulic tappets 9 abut against the top ends of the intake valve 5 and the exhaust valve 6.

Further, a rocker shaft holder 10 is integrally attached to the cylinder head 2 by means of bolts 42 which are located between adjacent ones of the cylinders and are located on the outer side of the cylinders, and which are threadedly secured in the cylinder head 2 by being passed through the rocker shaft holder 10 from above to below. An intake rocker shaft 11 and an exhaust rocker shaft 12 are passed through the rocker shaft holder 10, and an intake rocker arm 13 and an exhaust rocker arm 14 are swingably engaged on the intake rocker shaft 11 and the exhaust rocker shaft 12, respectively. An intake camshaft 15, an exhaust camshaft 16, and cam holders 17 are consecutively superposed in an upper portion of the rocker shaft holder 10 in such a manner as to be located above the intake rocker arm 13 and the exhaust rocker arm 14. The intake camshaft 15 and the exhaust camshaft 16 are pivotally supported to the rocker shaft holder 10 and the cam holder 17 by means of bolts 18 which are passed through the cam holder 17 and are threadedly secured in the rocker shaft holder 10. The intake camshaft 15 and the exhaust camshaft 16 are connected to a crankshaft by means of sprockets and chains (not shown). Each time the crankshaft undergoes two revolutions, the intake camshaft 15 and the exhaust camshaft 16 are adapted to undergo one revolution so as to be rotatively driven.

Furthermore, stem seals 20 are provided at upper ends of stems 19 of the intake valve 5 and the exhaust valve 6, and valve spring retainers 21 are attached to upper ends of the intake valve 5 and the exhaust valve 6. Valve springs 23 are each loaded between a valve-spring receiving portion 22 on the cylinder head 2 and the valve spring retainer 21, whereby the intake valve 5 and the exhaust valve 6 are urged by the spring forces of the valve springs 23 so as to be closed constantly.

In addition, in the rocker shaft holder 10, an intermediate connecting portion 24 located midway between the intake camshaft 15 and the exhaust camshaft 16 is formed to be low, as shown in FIG. 1. A cylinder head cover 25 is formed in such a shape that a widthwise central portion of the cylinder head cover 25 perpendicular to the intake camshaft 15 and the exhaust camshaft 16 which are parallel to the unillustrated crankshaft is indented downward so as to have a slight gap between the rocker shaft holder 10 and the cam holder 17. A hole 27 is formed in a central recessed portion 26 of the cylinder head cover 25, a bolt 28 is passed through the hole 27 from above to below. Further, a lower end threaded portion of the bolt 28 is integrally threadedly secured to the head 42*a* of a bolt 42 provided in the intermediate connecting portion 24.

Further, a lower annular projection 30 of a rubber bush 29, which is an annular elastic member, is fitted between the hole 27 in the cylinder head cover 25 and the bolt 28. A radially positioning stepped portion 31 which is reinforced by a thin plate is formed above the rubber bush 29. The radially positioning stepped portion 31 is reinforced with a lower retainer 43 being a lower spring receiving portion. A coil spring 32 which is loosely fitted over the bolt 28, i.e., is fitted with a clearance therebetween, is interposed between an upper retainer 33 which is an upper spring receiving portion and passed through and retained by the bolt 28, and the lower retainer 43 integral with the radially positioning stepped portion 31 of the rubber bush 29.

Furthermore, packing 34 is fitted over the entire lower outer peripheral edge of the cylinder head cover 25.

Figure 3:
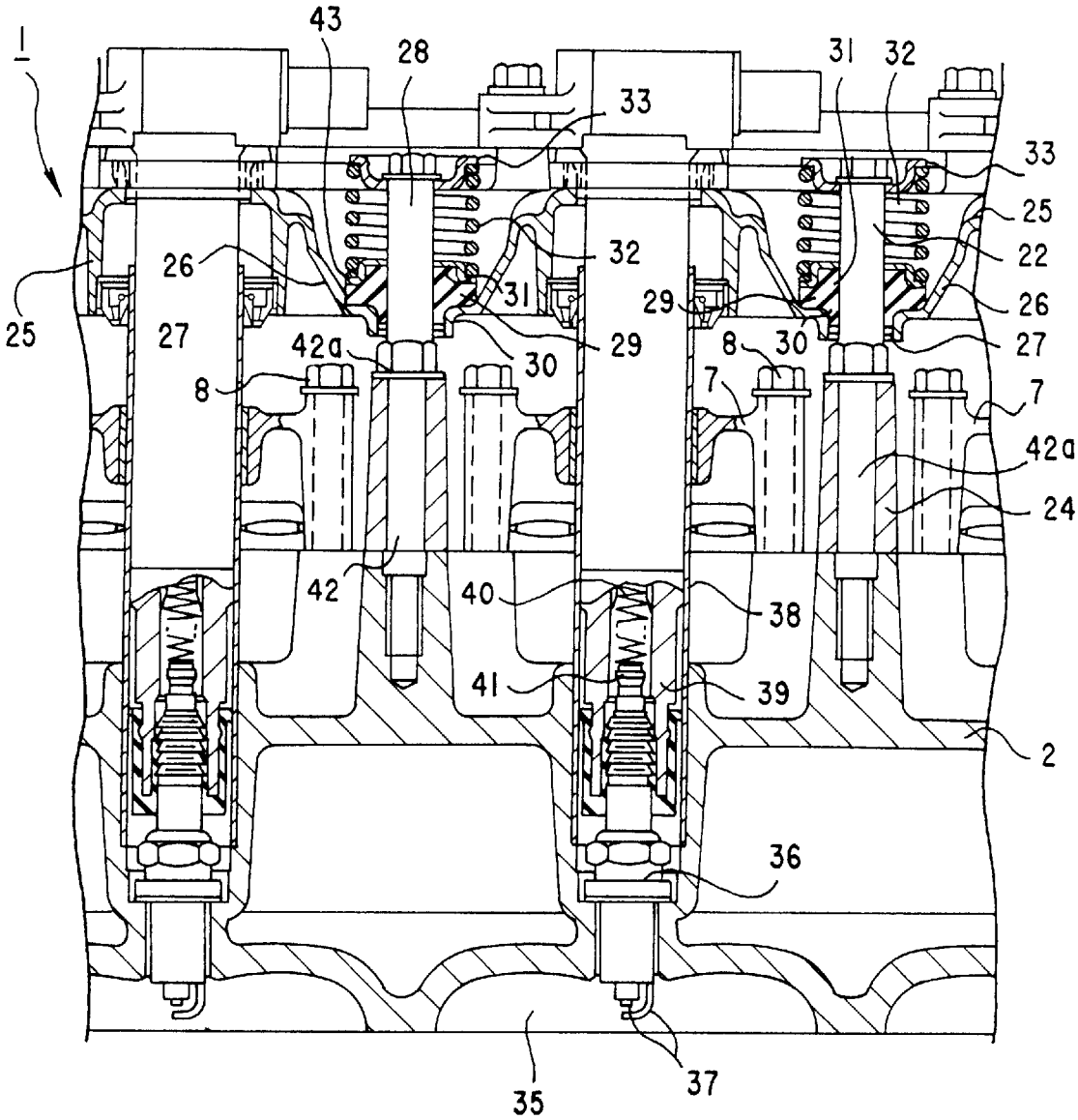
FIG. 3 is a longitudinal cross-sectional view taken along line III—III of FIG. 2.

Moreover, as shown in FIG. 3, an ignition plug 36 is passed through and threadedly secured in the cylinder head 2 in such a manner that an electrode portion 37 of the ignition plug 36 is exposed in a combustion chamber 35 above the cylinder. A high-tension cord pipe 39 is fitted in a guide pipe 38 which is passed through the cylinder head cover 25 and whose lower end is fitted in the cylinder head 2. A lower end of the high-tension cord pipe 39 is connected to a head terminal 41 of the ignition plug 36 by means of an electrically conductive coil spring 40.

Figure 2:
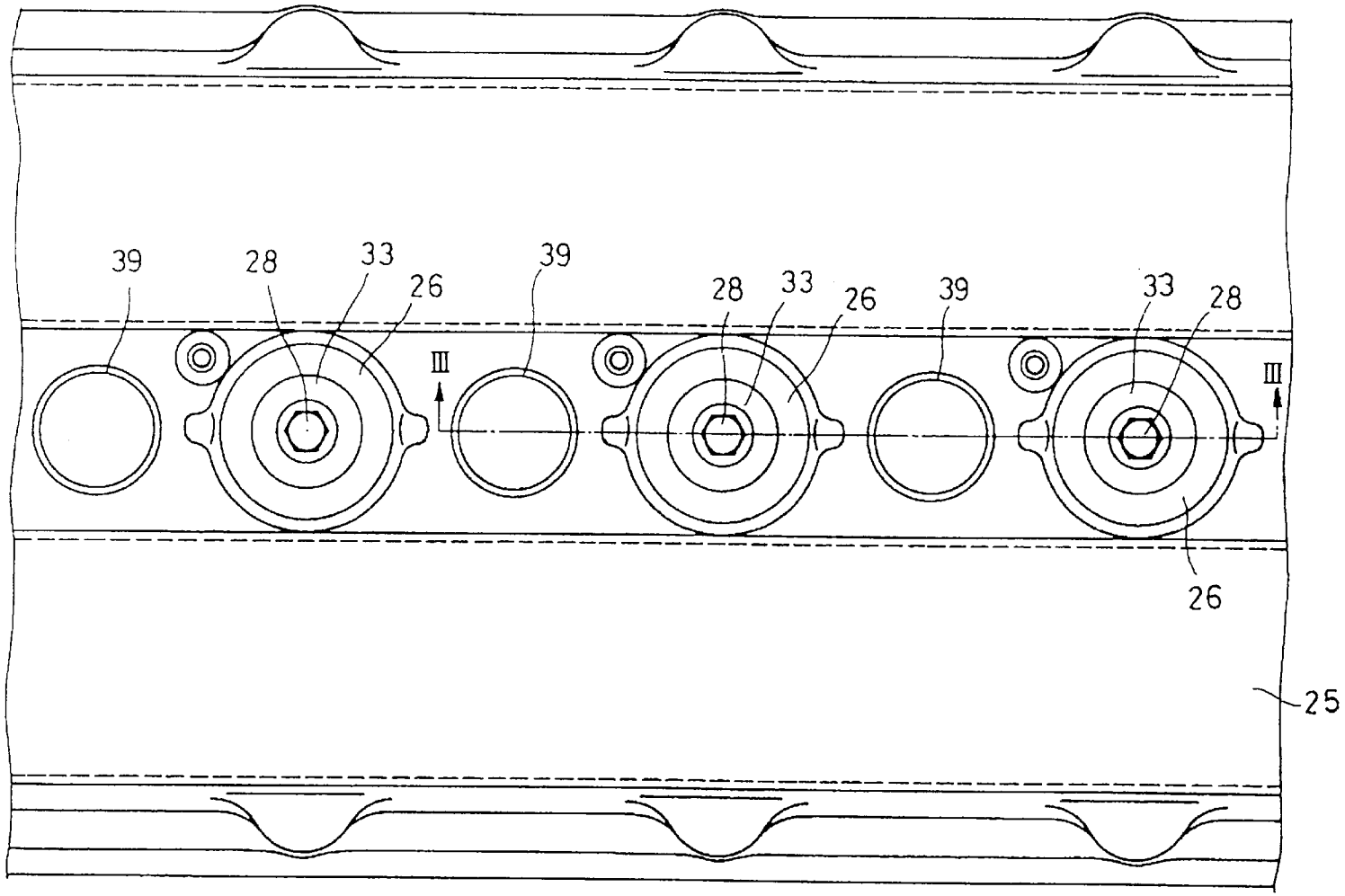
FIG. 2 is a plan view of FIG. 1.

Since the embodiment illustrated in FIGS. 1 through 3 is arranged as described above, when the internal combustion engine 1 is started, and the unillustrated crankshaft is rotated, the intake camshaft 15 and the exhaust camshaft 16 are rotatively driven at a half speed thereof. Each time the crankshaft undergoes two revolutions, the intake rocker arm 13 and the exhaust rocker arm 14 are respectively swung downward by the intake camshaft 15 and the exhaust camshaft 16 once at a predetermined timing. In correspondence with the downward swinging motion of the intake rocker arm 13 and the exhaust rocker arm 14, the intake valve 5 and the exhaust valve 6 are respectively driven downward by means of the hydraulic tappet 9 by overcoming the spring forces of the valve springs 23, thereby opening the intake valve 5 and the exhaust valve 6. Thus, the fresh air-fuel mixture in the intake passage 3 is supplied to the combustion chamber 35 through the intake valve 5, while the combustion gases in the combustion chamber 35 are discharged into the exhaust passage 4 through the exhaust valve 6.

In addition, the cylinder head cover 25 is pressed downward by the spring forces of the coil springs 32 in the recessed portions 26 in the widthwise central portion, and the outer peripheral edge of the cylinder head cover 25 is pressed uniformly against the top surface of the cylinder head 2 by means of the packing 34, thereby allowing the space within the cylinder head cover 25 to be hermetically sealed reliably.

Further, since the head of the bolt 28 and the retainer 33 are lower than top portions 25*a* on both widthwise sides of the cylinder head cover 25, the overall height of the internal combustion engine 1 does not become high, making the internal combustion engine 1 compact.

Furthermore, since the depth and area of the recessed portion 26 of the cylinder head cover 25 are sufficiently large, the length and the winding diameter of the coil spring 32 can be made large. As a result, even if the spring constant of the coil spring 32 becomes small and the distance between the radially positioning stepped portion 31 of the rubber bush 29 and the retainer 33 changes, the pressing force for pressing the cylinder head 2 from the cylinder head cover 25 by means of the spring forces of the coil springs 32 does not change substantially, and a stable pressing force can be obtained. Then, by slightly changing the distance between the radially positioning stepped portion 31 of the rubber bush 29 and the retainer 33, it is possible to finely adjust the pressing force pressing the cylinder head 2 from the cylinder head cover 25.

Moreover, since the hole 27 in the recessed portion 26 of the cylinder head cover 25 is engaged through the annular projection 30 of the rubber bush 29 at a portion adjacent the lower threadedly engaging portion of the bolt 28, the cylinder head cover 25 is prevented from becoming offset in its longitudinal and transverse directions, and is able to maintain its mounted position reliably.

In addition, since the upper and lower ends of the coil spring 32 are fitted to the upper retainer 33 and the lower retainer 43 integral with the radially positioning stepped portion 31 of the rubber bush 29, the coil spring 32 is held stably.

Further, the bolt 28, which is integrally connected to the cylinder head 2 by means of the intermediate connecting portion 24 of the rocker shaft holder 10 and the bolts 42*a*, is further connected to the recessed portion 26 of the cylinder head cover 25 by means of the retainer 33, the coil spring 32 and further, the rubber bush 29. Therefore, the vibrations of the internal combustion engine 1 are dampened by not only the coil springs 32 but also the rubber bushes 29, and the transmission of the vibrations to the cylinder head cover 25 is thereby suppressed, so that it is possible to lower the noise level.

Moreover, by using springs having a small spring constant, it is unnecessary to severely adjust the amount of tightening the head bolts (rotational angle) at the time of mounting the head cover.

Then, when the packing 34 has become worn out, even if the distance between the radially positioning stepped portion 31 and the retainer 33 has become short, since the spring constant is small, it is possible to minimize a drop in the tightening force, and a stable tightening force can be obtained.

Figure 4:
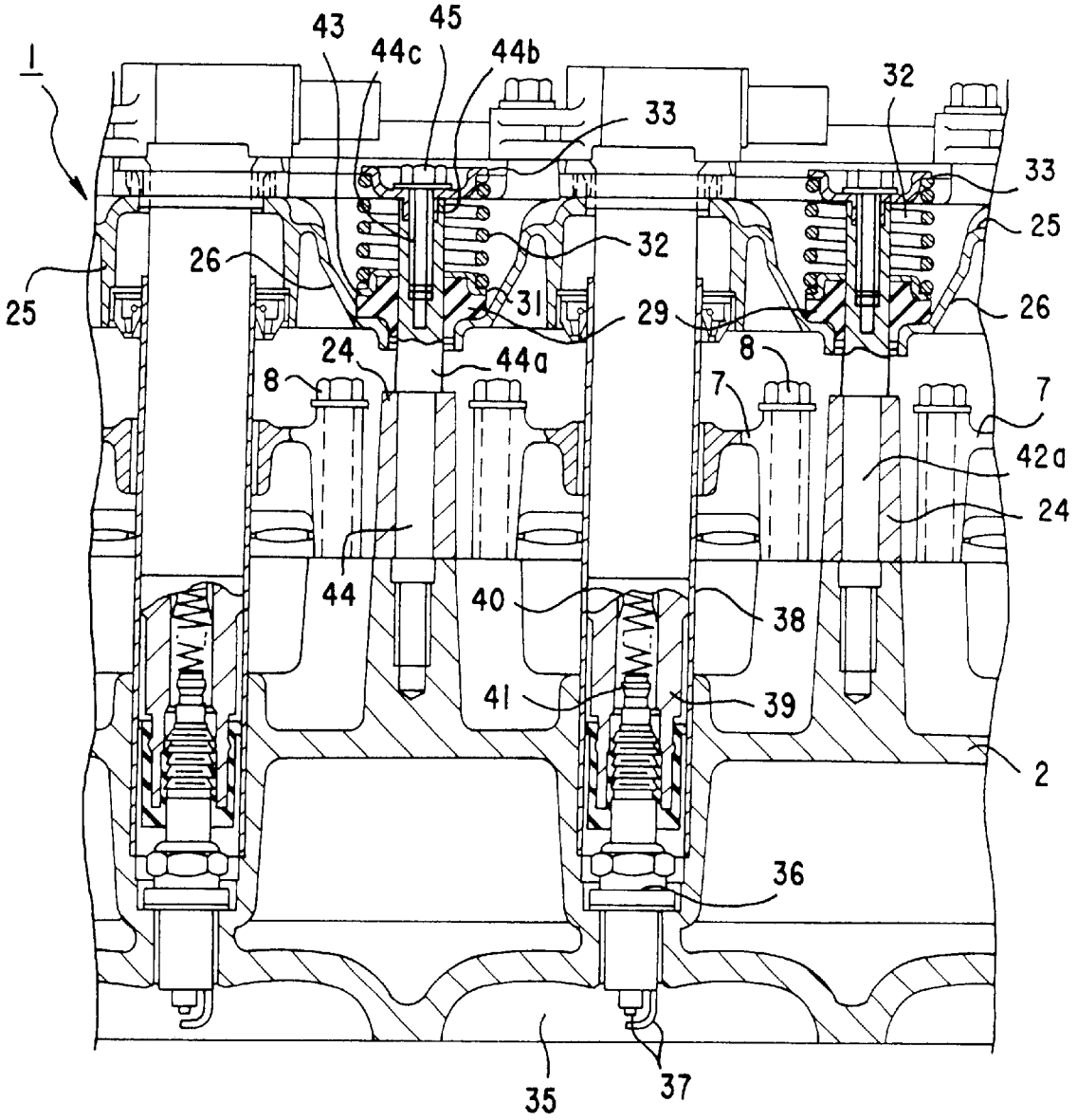
FIG. 4 is a primary longitudinal cross-sectional view showing another embodiment of the present invention different from the embodiment shown in FIGS. 1 to 3.

In the embodiment shown in FIGS. 1 through 3, the connecting member is the bolt 28 which passes through the recessed portion 26 of the cylinder cover 25 and is fixed to the cylinder head 2 side at one end thereof. This bolt 28 is not directly fixed to the cylinder head 2 but is threadedly connected at the lower end thereof to the bolt 42 which passes through the intermediate portion 24 of the rocker shaft holder 10 and is threadedly secured to the cylinder head 2. As shown in FIG. 4, however, the bolt 44 functioning as a connecting member may pass through the intermediate portion 24 of the rocker shaft holder 10 so as to be threadedly connected to the cylinder head 2 for integral fixation thereto.

In the embodiment shown in FIG. 4, a head portion 44*a* of a bolt 44 is set as substantially long as that of the bolt 28 shown in FIGS. 1 through 3. A hexagonal hole 44*b* is formed in the head portion 44*b* of the bolt 44 and a threaded hole 44*c*, which is deeper than the hexagonal hole, is formed in the same head portion concentrically with the hexagonal hole 44*b*. The upper retainer 33 is placed on the top surface of the head portion 44*a* of the bolt 44, so that the upper retainer 33 is integrally mounted on the head portion 44*a* of the bolt 44 by means of the bolt 45 which passes through the upper retainer 33 and is threadedly secured in the threaded hole 44*c*.

Thus, the connecting member may directly be secured to the cylinder head 2 as with the bolt 44 shown in FIG. 4. Instead, as with the bolt 28 shown in FIGS. 1 through 3, the connecting member may be secured to the bolt 42 threadedly secured to the cylinder head 2 after passing through the camshaft holder 10, or, in other words, the bolt 28 may be indirectly secured to the cylinder head 2 via the bolt 42.

In addition, in the embodiment shown in FIGS. 1 through 3, the cam holder 17 for holding the intake camshaft 15 and the exhaust camshaft 16 is divided such that those camshafts are held separately. However, in the cylinder head cover mounting structure illustrated in FIGS. 5 and 6, the cam holder 46 is constructed as a one-piece component which is adapted to simultaneously press down the intake camshaft 15 and the exhaust camshaft 16.

Figure 5:
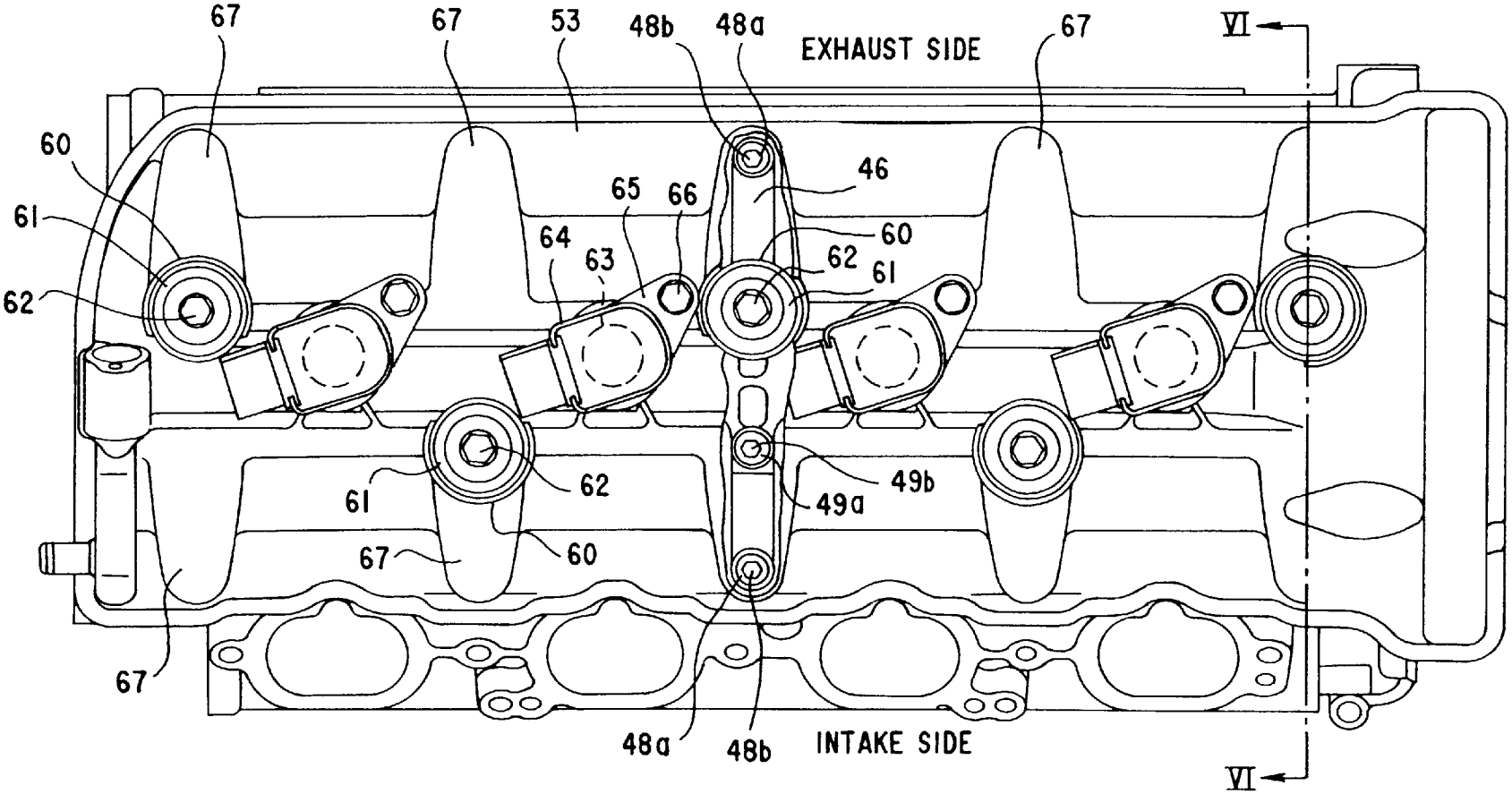
FIG. 5 is a partially cut-away plan view showing still another embodiment of the present invention different from the embodiments shown in FIGS. 1 to 4.
Figure 6:
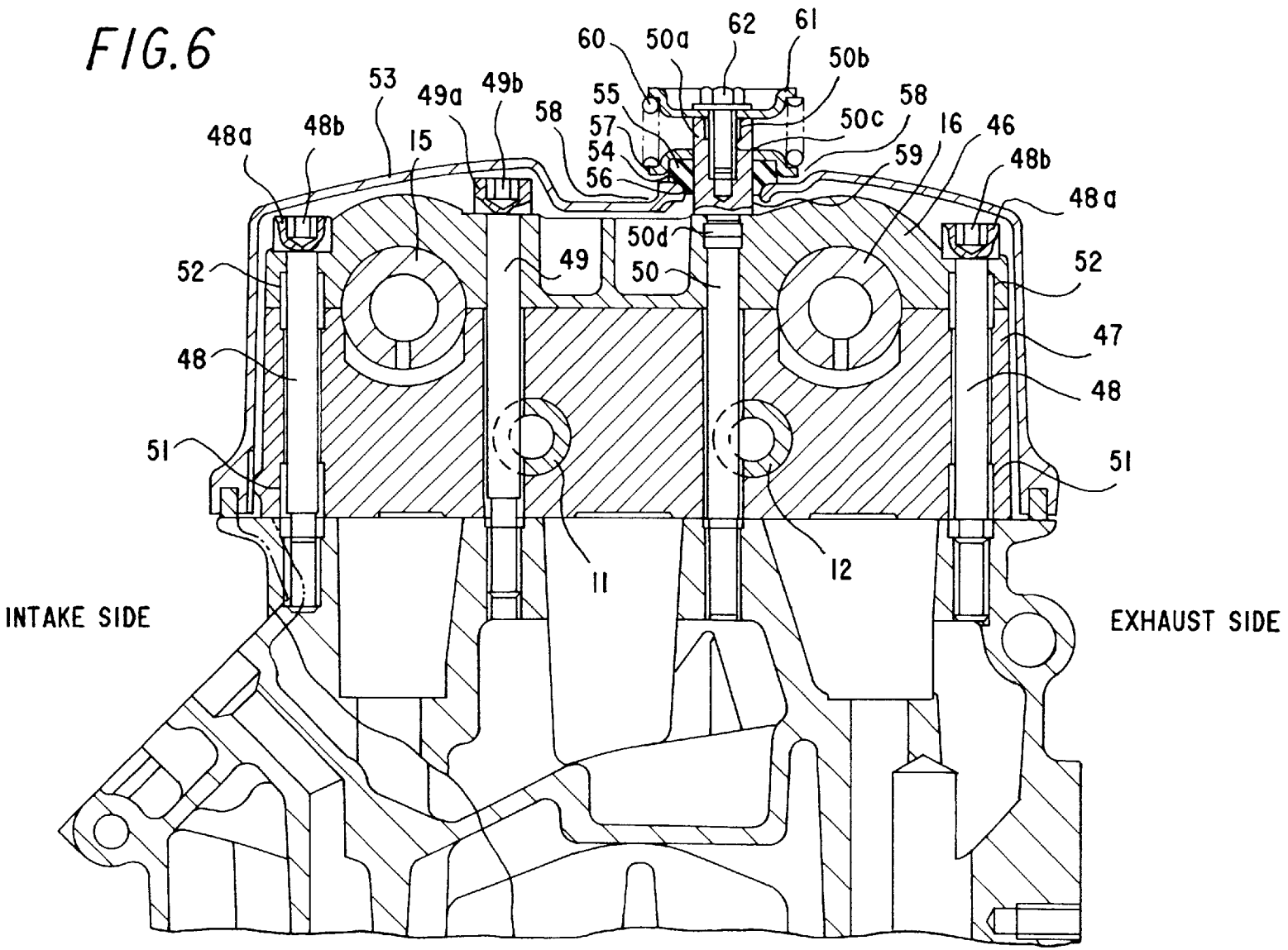
FIG. 6 is a transverse cross-sectional view taken along line VI—VI of FIG. 5.

Moreover, in the embodiment shown in FIGS. 5 and 6, provided on this structure as a bolt which passes through a cam holder 46 and a rocker shaft holder 47 for threaded securement to the cylinder head 2 are two bolts 48 which are disposed at outer side portions of the cam holder 46 and the rocker shaft holder 47, and bolts 49, 50 of two different types which are disposed one for each type at central portions of the cam holder 46 and the rocker shaft holder 47. Hexagonal holes 48*b*, 49*b*, 50*b* are formed in cylindrical head portions 48*a*, 49*a*, 50*a* of the respective bolts 48, 49, 50. A tool is to be fitted in the respective hexagonal holes 48*b*, 49*b*, 50*b* for screwing the associated bolts.

In addition, positioning sleeves 51, 52 are fitted in the bolt holes 48 in which the bolts 48 are inserted, respectively, in the vicinity of a joint portion between the cylinder head 2 and the rocker shaft holder 47, and a joint portion between the rocker shaft holder 47 and the cam holder 46, respectively, for preventing relative displacement of the joint portions.

Furthermore, as shown in FIG. 5, the bolts 49, 50 disposed at the central portions of the cam holder 46 and the rocker shaft holder 47 are arranged in a zigzag fashion on the intake side and the exhaust side (in FIG. 5, the bolt 50 is shown as being disposed on the exhaust side). A cylindrical head portion 50*a* of the bolt 50 is, as shown in FIG. 6, formed so as to become longer than the other cylindrical head portions 48*a*, 49*a*. A longer threaded hole 50*c* is formed into the cylindrical head portion 50*a* of the bolt 50 concentrically with the hexagonal hole 50*b* in such a manner as to extend deeper than the hexagonal hole 50*b*. A portion 50*d* contiguous with the cylindrical head portion 50*a* of the bolt 50 is formed thicker such that it fits closely in the bolt hole of the cam holder 46 so as to leave as little gap as possible.

Formed in a central portion of a cylinder head cover 53 is a recessed portion 58 for accommodating a rubber bush 54 in the form of a ring-like resilient member and a lower retainer 57 adapted to contact a radial positioning stepped portion 55 on an upper portion of the rubber bush 54. A hole 59 is formed in the recessed portion 58, and the bolt 50 passes through the hole 59 from top to bottom. A lower annular projection 56 of the rubber bush 54 is fitted in between the hole 59 of the cylinder head cover 53 and the bolt 50, and the lower retainer 57 is placed on the radial positioning stepped portion 55 on the rubber bush 54. A coil spring 60 is loosely concentrically fitted over the bolt 50 relative to the head portion 50*a* thereof so as to be placed on the outer circumferential portion of the lower retainer. An upper retainer 61 is applied to an upper portion of the coil spring 60, and a bolt 62 is threadedly secured in the bolt hole 50*c* of the holt 50 after it passes through the upper retainer 61. Thus, the lower end edge of the cylinder head cover 53 is pressed downward by virtue of spring force generated through resilient compression deformation of the coil spring 60 to thereby be brought into press contact with the upper surface of the cylinder head 2.

In addition, as shown in FIG. 5, an ignition coil insertion hole 63 is formed in the cylinder head cover 53 at an intermediate position between adjacent bolts 52 of the bolts 50 disposed in the zigzag fashion. A lower cylindrical portion of an ignition coil 64 is inserted into the ignition coil insertion hole 63,and a mounting piece 65 is integrally formed on the ignition coil 64. Then, the ignition coil 64 is integrally mounted on the cylinder head cover 53 by means of a bolt 66 which passes through the mounting piece 65 and is then threadedly secured in a threaded hole (not shown) in the cylinder head cover 53.

Moreover, as shown in FIG. 3, the ignition plug (not shown) is integrally mounted in the cylinder head 2 below the ignition coil 64 in a state in which it is electrically connected.

Furthermore, as shown in FIG. 5, a curved portion 67 is formed on the cylinder head cover 53 above the cam holder 46 in such a manner as to expand upwardly, and this curved portion 67 functions to increase the strength and rigidity of the cylinder head cover 53, the curved portion 67 accommodating the cam holder 46.

In the embodiment shown in FIGS. 5 and 6, since at least the rubber bush 54 and the lower retainer 57 acting as a lower spring seat portion are accommodated in the recessed portion 58 of the cylinder head cover 53, the cylinder head mounting structure does not project largely from the cylinder head cover 53, thereby making it possible to make the internal combustion engine 1 smaller.

Since the cam holder 46 is made to be a one-piece so as to allow the intake rocker shaft 11 and the exhaust rocker shaft 12 to be mounted simultaneously, the mounting strength and rigidity of the cam holder 46 is increased, and since this one-piece construction helps reduce the number of components used, the costs can be reduced.

Furthermore, since the respective cam holder 46 and rocker shaft holder 47 are clamped together with the four bolts 48, 49, 50 which pass through them and are threadedly secured in the cylinder head 2, the cam holder 46 and the rocker shaft holder 47 can tightly be mounted on the cylinder head 2, and the number of bolts as a connecting member for use in mounting the cam holder 46 and the rocker shaft holder 47 can be reduced, thereby making it possible to reduce costs incurred in this aspect as well.

In addition, since the bolt 50, a member for mounting the cam holder 46 and the rocker shaft holder 47 on the cylinder head 2, also functions as a member for loosely supporting the ignition coil 64, the number of components can further be reduced.

On top of that, since the ignition coil 64 is mounted on the cylinder head cover 53 at an intermediate position between adjacent bolts 50 of a group of those disposed in a zigzag fashion, the ignition coil 64 can be held strongly and stably, and without any interference with adjacent bolts 50, a relatively large ignition coil 64 can be mounted on the cylinder head cover 53.

Furthermore, since the cylinder head cover 53 is pressed downward in a widely dispersed fashion, as a whole, by the coil springs 60 loosely fitted over the bolts 50 disposed in a zigzag fashion, with the lower circumferential edge of the cylinder head cover 53 being brought into uniform abutment with the upper surface of the cylinder head 2, sealing performance between the cylinder head 2 and the cylinder head cover 53 can be improved.

Moreover, since the curved portion 67 expanding upwardly is formed on the cylinder head cover 53, the strength and rigidity of the cylinder head cover 53 can be increased, and therefore there is eliminated a risk of the cylinder head cover 53 being deformed by virtue of the spring force of the coil springs 60, and there is no risk of the cylinder head cover 53 being resonated due to vibrations of the internal combustion engine 1.

In addition, since the cylinder head cover 53 is configured such that the curved portions 67 expanding upwardly are formed only in the vicinity of the cam holders 46 which protrude upwardly with the other portions being configured so as to closely conform to the configuration of the cylinder head 2.

While only certain embodiments of the invention have been specifically described herein, it will apparent that numerous modifications may be made thereto without departing from the spirit and scope of the invention.

The present disclosure relates to the subject matter contained in Japanese patent application No. Hei.10-248838 filed on Sep. 2, 1998 which is expressly incorporated herein by reference in its entirety.

What is claimed is:

1. A structure for mounting a cylinder head cover of an internal combustion engine in which an outer peripheral edge of a cylinder head cover abuts against a cylinder head side portion, and said cylinder head cover is mounted on said cylinder head side portion, comprising:

a connecting member passed through a recessed portion which is formed in a central portion of said cylinder head cover as viewed in a widthwise direction perpendicular to a crankshaft, said connecting member having one end fixed to said cylinder head side portion and the other end provided with a spring receiving portion; and a coil spring arranged around said connecting member, said coil spring being clamped in a compressed state between a bottom surface of said recessed portion of said cylinder head cover and said spring receiving portion, wherein said coil spring, said connecting member, and said spring receiving portion are accommodated within said recessed portion of said cylinder head cover, and said connecting member is secured to a connecting portion which integrally connects a camshaft holder for respectively supporting an intake camshaft and an exhaust camshaft which are respectively located on both sides of said recessed portion of said cylinder head cover.

2. The structure for mounting a cylinder head cover of an internal combustion engine according to claim 1, wherein said spring receiving portion is structured by a retainer separately provided with said connecting member.

3. The structure for mounting a cylinder head cover of an internal combustion engine according to claim 1, wherein said cylinder head side portion is constructed by one of a cylinder head, a cam holder and a rocker shaft holder.

4. The structure of mounting a cylinder head cover of an internal combustion engine according to claim 1, wherein said cylinder head side portion is constructed by a cylinder head, a cam holder and a rocker shaft holder.

5. A structure for mounting a cylinder head cover of an internal combustion engine in which an outer peripheral edge of a cylinder head cover abuts against a cylinder head side portion, and said cylinder head cover is mounted on said cylinder head side portion, comprising:

a connecting member passed through a recessed portion which is formed in a central portion of said cylinder head cover as viewed in a widthwise direction perpendicular to a crankshaft, said connecting member having one end fixed to said cylinder head side portion and the other end provided with a spring receiving portion; and a coil spring arranged around said connecting member, said coil spring being clamped in a compressed state between a bottom surface of said recessed portion of said cylinder head cover and said spring receiving portion, wherein said coil spring, said connecting member, and said spring receiving portion are accommodated within said recessed portion of said cylinder head cover, one end of said coil spring abuts against said cylinder head cover by means of an annular elastic member, a head cover-side end portion of said annular elastic member is fitted between said cylinder head cover and said connecting member, and a radially positioning stepped portion interposed in an inner surface of said coil spring is formed at the other end portion of said annular elastic member.

6. The structure for mounting a cylinder head cover of an internal combustion engine according to claim 5, wherein said spring receiving portion is structured by a retainer separately provided with said connecting member.

7. The structure for mounting a cylinder head cover of an internal combustion engine according to claim 5, wherein said cylinder head side portion is constructed by one of a cylinder head, a cam holder and a rocker shaft holder.

8. The structure of mounting a cylinder head cover of an internal combustion engine according to claim 5, wherein said cylinder head side portion is constructed by a cylinder head, a cam holder and a rocker shaft holder.

9. A structure for mounting a cylinder head cover of an internal combustion engine in which an outer peripheral edge of a cylinder head cover abuts against a cylinder head side portion, and said cylinder head cover is mounted on said cylinder head side portion, comprising:

a connecting member passed through a recessed portion which is formed in an upper portion of said cylinder head cover, said connecting member having one end fixed to said cylinder head side portion and the other end provided with an upper spring receiving portion; and a coil spring arranged around said connecting member, said coil spring being clamped in a compressed state between said upper spring receiving portion and a lower spring receiving portion provided in a bottom surface-side of said recessed portion of said cylinder head cover and by means of an annular elastic member, wherein said lower spring receiving portion is accommodated within said recessed portion of said cylinder head cover, and said connecting member is secured to a connecting portion which integrally connects a camshaft holder for respectively supporting an intake camshaft and an exhaust camshaft which are respectively located on both sides of said recessed portion of said cylinder head cover.

10. The structure for mounting a cylinder head cover of an internal combustion engine according to claim 9, wherein said upper spring receiving portion and said lower spring receiving portion are structured by retainers separately provided with said connecting member.

11. The structure for mounting a cylinder head cover of an internal combustion engine according to claim 9, wherein said cylinder head side portion is constructed by one of a cylinder head, a cam holder and a rocker shaft holder.

12. The structure of mounting a cylinder head cover of an internal combustion engine according to claim 9, wherein said cylinder head side portion is constructed by a cylinder head, a cam holder and a rocker shaft holder.

13. A structure for mounting a cylinder head cover of an internal combustion engine in which an outer peripheral edge of a cylinder head cover abuts against a cylinder head side portion, and said cylinder head cover is mounted on said cylinder head side portion, comprising:

a connecting member passed through a recessed portion which is formed in an upper portion of said cylinder head cover, said connecting member having one end fixed to said cylinder head side portion and the other end provided with an upper spring receiving portion; and a coil spring arranged around said connecting member, said coil spring being clamped in a compressed state between said upper spring receiving portion and a lower spring receiving portion provided in a bottom surface-side of said recessed portion of said cylinder head cover and by means of an annular elastic member, wherein said lower spring receiving portion is accommodated within said recessed portion of said cylinder head cover, a head cover-side end portion of said annular elastic member is fitted between said cylinder head cover and said connecting member, and a radially positioning stepped portion interposed in an inner surface of said coil spring is formed at the other end portion of said annular elastic member.

14. The structure for mounting a cylinder head cover of an internal combustion engine according to claim 13, wherein said lower spring receiving portion is structured by a retainer partially provided between said inner surface of said coil spring and said radially positioning stepped portion in such a manner as to contact with said inner surface of said coil spring.

15. The structure for mounting a cylinder head cover of an internal combustion engine according to claim 13, wherein a spring receiving portion is structured by a retainer separately provided with said connecting member.

16. The structure for mounting a cylinder head cover of an internal combustion engine according to claim 13, wherein said cylinder head side portion is constructed by one of a cylinder head, a cam holder and a rocker shaft holder.

17. The structure of mounting a cylinder head cover of an internal combustion engine according to claim 13, wherein said cylinder head side portion is constructed by a cylinder head, a cam holder and a rocker shaft holder.

18. A structure for mounting a cylinder head cover of an internal combustion engine in which an outer peripheral edge of a cylinder head cover abuts against a cylinder head side portion, and said cylinder head cover is mounted on said cylinder head side portion, comprising:

a connecting member passed through a recessed portion which is formed in an upper portion of said cylinder head cover, said connecting member having one end fixed to said cylinder head side portion and the other end provided with a spring receiving portion; and a coil spring arranged around said connecting member, said coil spring being clamped in a compressed state between a bottom surface of said recessed portion of said cylinder head cover and said spring receiving portion, wherein said connecting member is secured to said cylinder head side portion between an intake camshaft and an exhaust camshaft, which are provided within said cylinder head cover.

19. The structure for mounting a cylinder head cover of an internal combustion engine according to claim 18, wherein said connecting member is secured to a connecting portion which integrally connects a camshaft holder for respectively supporting an intake camshaft and an exhaust camshaft which are respectively located on both sides of said recessed portion of said cylinder head cover.

20. The structure for mounting a cylinder head cover of an internal combustion engine according to claim 18, wherein one end of said coil spring abuts against said cylinder head cover by means of an annular elastic member, a head cover-side end portion of said annular elastic member is fitted between said cylinder head cover and said connecting member, and a radially positioning stepped portion interposed in an inner surface of said coil spring is formed at the other end portion of said annular elastic member.

21. The structure for mounting a cylinder head cover of an internal combustion engine according to claim 18, wherein said spring receiving portion is structured by a retainer separately provided with said connecting member.

22. The structure for mounting a cylinder head cover of an internal combustion engine according to claim 18, wherein said cylinder head side portion is constructed by one of a cylinder head, a cam holder and a rocker shaft holder.

* * * * *